United States Patent [19]

Jones

[11] 4,412,470

[45] Nov. 1, 1983

[54] SYSTEM FOR COMMUNICATING DATA AMONG MICROCOMPUTERS IN AN ELECTRONIC MUSICAL INSTRUMENT

[75] Inventor: Edward M. Jones, Cincinnati, Ohio

[73] Assignee: Baldwin Piano & Organ Company, Cincinnati, Ohio

[21] Appl. No.: 271,133

[22] Filed: Jun. 8, 1981

[51] Int. Cl.[3] ..... G10H 7/00

[52] U.S. Cl. ..... 84/1.01; 84/1.03; 84/115

[58] Field of Search ..... 84/1.01, 1.03, 115

[56] References Cited

U.S. PATENT DOCUMENTS 4,320,683 3/1982 Whitefield ..... 84/115

*Primary Examiner*—Stanley J. Witkowski

*Attorney, Agent, or Firm*—Kirkland & Ellis

[57] ABSTRACT

The present invention provides a system for communicating data among microprocessors which are utilized to control an electronic musical instrument. A master microprocessor transmits a synchronizing signal comprising two, spaced pulses to the other microprocessors causing the other microprocessors to interrupt their operations and become synchronized with the synchronizing signal. Thereafter, according to a prearranged sequence, one microprocessor commences transmitting data while simultaneously the other microprocessors commence inputting data.

14 Claims, 5 Drawing Figures

SYSTEM FOR COMMUNICATING DATA AMONG MICROCOMPUTERS IN AN ELECTRONIC MUSICAL INSTRUMENT

BACKGROUND OF THE INVENTION

1. Field of the Invention

The present invention relates to an electronic musical instrument utilizing microprocessor control and more specifically to a system for communicating data among the microprocessors which control the electronic musical instrument whereby data is communicated synchronously to assure accurate data transfer and to minimize the time required for communication.

2. Description of the Prior Art

Some electronic musical instruments capable of sounding automatic accompaniment rhythms and sequences, generating chords in response to the playing of a key, and providing other musical functions utilize microprocessors to control the operation of the instrument to accomplish these functions. One such system, for example, is described in U.S. patent application Ser. No. 040,107 entitled "Automatic Control Apparatus for Chords and Sequences," filed May 8, 1979 now U.S. Pat. No. 4,292,874 and assigned to Baldwin Piano and Organ Company. As the number of desired control functions to be performed by the microprocessors increases to provide additional instrument features, the capability of a single microprocessor is exceeded and it becomes necessary to utilize two or more microprocessors to provide all of the functions desired in an instrument. Thus, various operations can be divided up among the microprocessors, and a greater number of functions can be provided by utilizing additional microprocessors. In a single instrument, however, it is necessary that the various microprocessors interact with each other so that operations are performed at the proper time and notes ultimately are sounded at the appropriate times to create the desired music. In addition, interaction among the microprocessors increases their efficiency by permitting data to be shared, thereby eliminating the expenditure of time and capacity in duplicating operations performed by another of the microprocessors. The present invention provides a system of data communication among microprocessors to satisfy the foregoing needs of providing additional functions with greater efficiency.

SUMMARY OF THE INVENTION

In an electronic musical instrument using microprocessors for controlling notes, chords, rhythms, sequences of notes, and other functions, a single microprocessor often does not have sufficient capacity to perform all of the needed functions. Therefore, a plurality of microprocessors is used with each microprocessor performing particular functions. A musical performance on an electronic musical instrument involving chords, rhythms, and sequences of notes requires complex and rapid switching of means which generate the desired sounds. Great accuracy in the timing and character of the sounds generated is necessary in order for the performance to be audibly and aesthetically acceptable. In order for the electronic musical instrument to produce the desired musical sound, it is necessary that the microprocessors operate synchronously. In addition, data produced by one microprocessor is frequently needed by another microprocessor in order to perform its assigned functions. Thus, for example, data corresponding to rhythm voices to be sounded, which can be obtained, for example, in a first microprocessor, can be communicated to another microprocessor to be outputted. Such sharing of functions facilitates efficient utilization of the microprocessors at all times. Therefore, it is necessary to communicate bits of data between microprocessors.

Each of the microprocessors is performing a unique program independently of the others to accomplish the particular functions assigned to it. Although all of the microprocessors may be operating in synchronism with the same clock, the microprocessors are not synchronized in their operations since, except during communications, each microprocessor is independently executing a unique "main program" of instructions. In order for a first microprocessor to send or receive data to or from, respectively, a second microprocessor, it is necessary that the transmission of data be coordinated between the two microprocessors. The present invention provides a method for coordinating the transmission of data among microprocessors. That is, the transmission of data by the transmitting microprocessor is synchronized with the receiving of data by each receiving microprocessor. Accurate synchronization is necessary in order to ensure that the data communicated is accurately received. This is essential in order to ensure that the desired sounds are generated by the musical instrument.

Synchronization of the microprocessors for the communication of data is accomplished by the transmission by a first microprocessor (referred to as the master microprocessor) of a synchronizing signal which is received by each of the other microprocessors (referred to as slave microprocessors). The synchronizing signal causes each of the slave microprocessors to become synchronized in time with the synchronizing signal so that data which is transmitted serially by either the master or a slave microprocessor is received correctly by the other microprocessors. When an interrupt signal is received by the slave microprocessors from the master microprocessor, they interrupt the execution of their respective main programs and begin execution of a sequence of instructions which synchronizes the receiving or inputting of data with the transmission of data so that the microprocessors correctly receive the data and then return to the points in their respective main programs where execution was interrupted by receipt of the synchronizing signal. The foregoing synchronous type of communication requires a minimum expenditure of time by each microprocessor.

DETAILED DESCRIPTION OF THE PREFERRED EMBODIMENT

Figure 1:
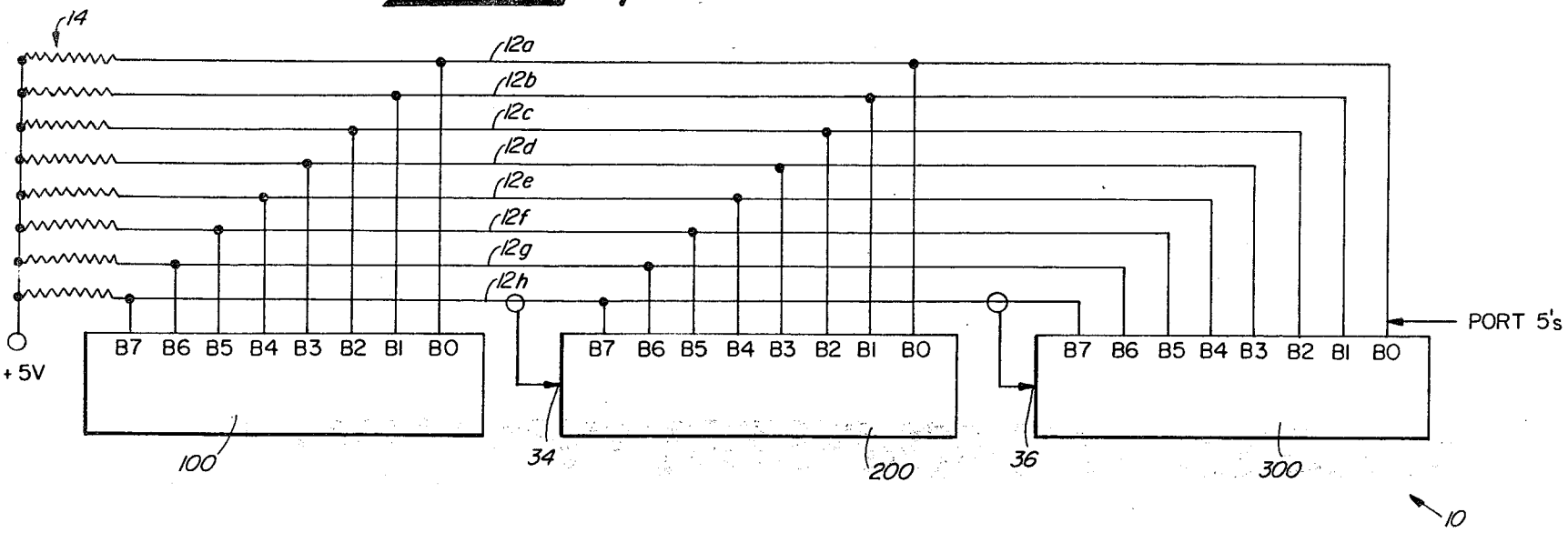
FIGS. 1 and 1A are block diagrams illustrating the interconnections of three microprocessors for data communications in accordance with the present invention.

FIG. 1 illustrates three microprocessors 100, 200, and 300 with bits B0 through B7 of port 5 of each microprocessor connected through an eight-wire communication bus comprising lines 12*a–h* to the corresponding bits B0 through B7 of the other microprocessors. Although the present invention is described herein for communications among three microprocessors, it should be noted that the present invention is also applicable to a system employing a lesser or greater number of microprocessors. Any one of the microprocessors 100, 200, or 300 can transmit data to the others by pulling selected bits B0 through B7 low, as described hereinafter. The states of bits B0 through B7 of the transmitting microprocessor are transmitted via lines 12*a–h* to the other microprocessors, which can either receive the communication by executing input instructions or bypass the communication by executing a delay routine.

Figure 2:
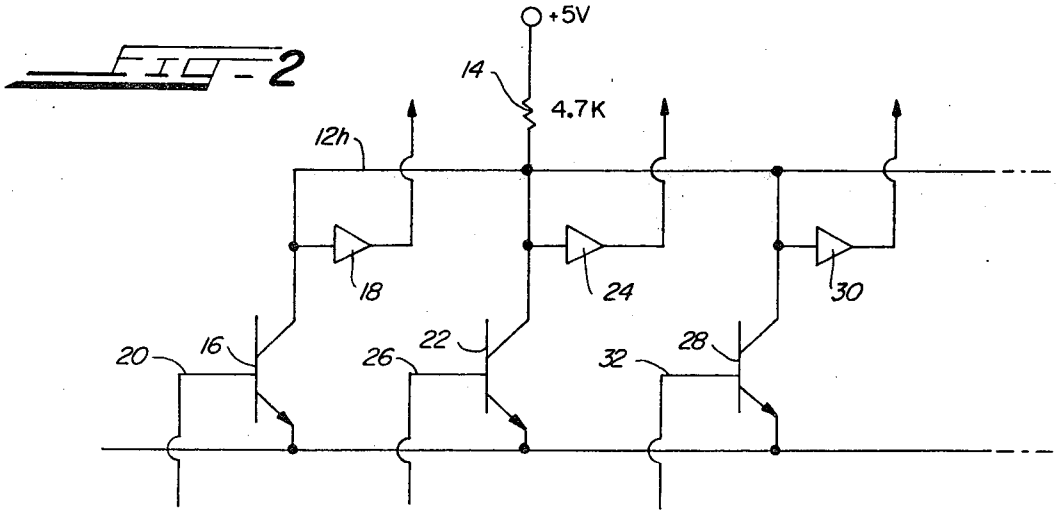
FIG. 2 is a schematic diagram illustrating the open collector type of port utilized in the present invention and the interconnection of a series of microprocessors.

As illustrated in FIG. 1, terminals B0 through B7 of port 5 of each of the microprocessors 100, 200, and 300 also are connected through lines 12*a–h* to a +5 volt source through a 4.7k resistor 14. By making port 5 an open collector type of port and providing a set of 4.7k pull-up resistors, it is possible for a large number of microprocessors to be connected together for data communications according to the present invention. An open collector type of port is illustrated in FIG. 2, which shows bit B7 of each of microprocessors 100, 200, and 300 connected together via output line 12*h*. In FIG. 2, transistor 16 is associated with bit B7 of microprocessor 100, transistor 22 is associated with bit B7 of microprocessor 200, and transistor 28 is associated with bit B7 of microprocessor 300. With no signal applied to the base of any of the three transistors 16, 22, or 28, all of the three transistors remain off (i.e., the collector is "open") so that the collector of each is in the high state due to the connection to the +5 volt source through the 4.7k resistor 14. The high or low state of transistors 16, 22, and 28 is sensed by amplifiers 18, 24, and 30, respectively, and is transferred through these amplifiers to appropriate registers in memory by conventional methods known in the art.

The low state of bit B7 of microprocessor 100, for example, is communicated as follows. Transistor 16 is turned on by the application of a positive signal to its base through line 20. When transistor 16 is on, amplifier 18 is effectively connected to ground (i.e., the low state) through transistor 16. Since the collectors of transistors 22 and 28 are connected directly to the collector of transistor 16 via line 12*h*, the low state of bit B7 of microprocessor 100 (i.e., the low voltage at the collectors of transistor 16) also appears on the collector of transistors 22 and 28 even through transistors 22 and 28 are off. The low state is then sensed by amplifiers 24 and 30 of microprocessors 200 and 300, respectively. The low state of bit B7 of microprocessors 200 and 300 is communicated in a similar manner by applying a positive signal to the base of transistor 22 or 28 via line 26 or 32, respectively.

Connecting the collectors of each of the three corresponding transistors to the +5 volt source through a common resistor 14 reduces the amount of current which flows when one of the transistors is turned on to pull bit B7 to the low state. This arrangement also causes the low state of the collector of any of the transistors to be transferred to the collector of each of the other transistors via the associated line 12*a–h* of the communication bus.

To avoid ambiguity, the collectors of the transistors in the receiving microprocessors must be high when communication is commenced. Otherwise, since the low state of a collector of the receiving microprocessor would not be changed by the high state of the corresponding collector of the transmitting microprocessor, the corresponding bit sensed by the associated amplifier would incorrectly correspond to the low state. In the foregoing manner, the low state of bits B0 through B7 of any of the microprocessors is transferred to the other microprocessors, assuming that the other microprocessors are initially in the high state.

Figure 3:
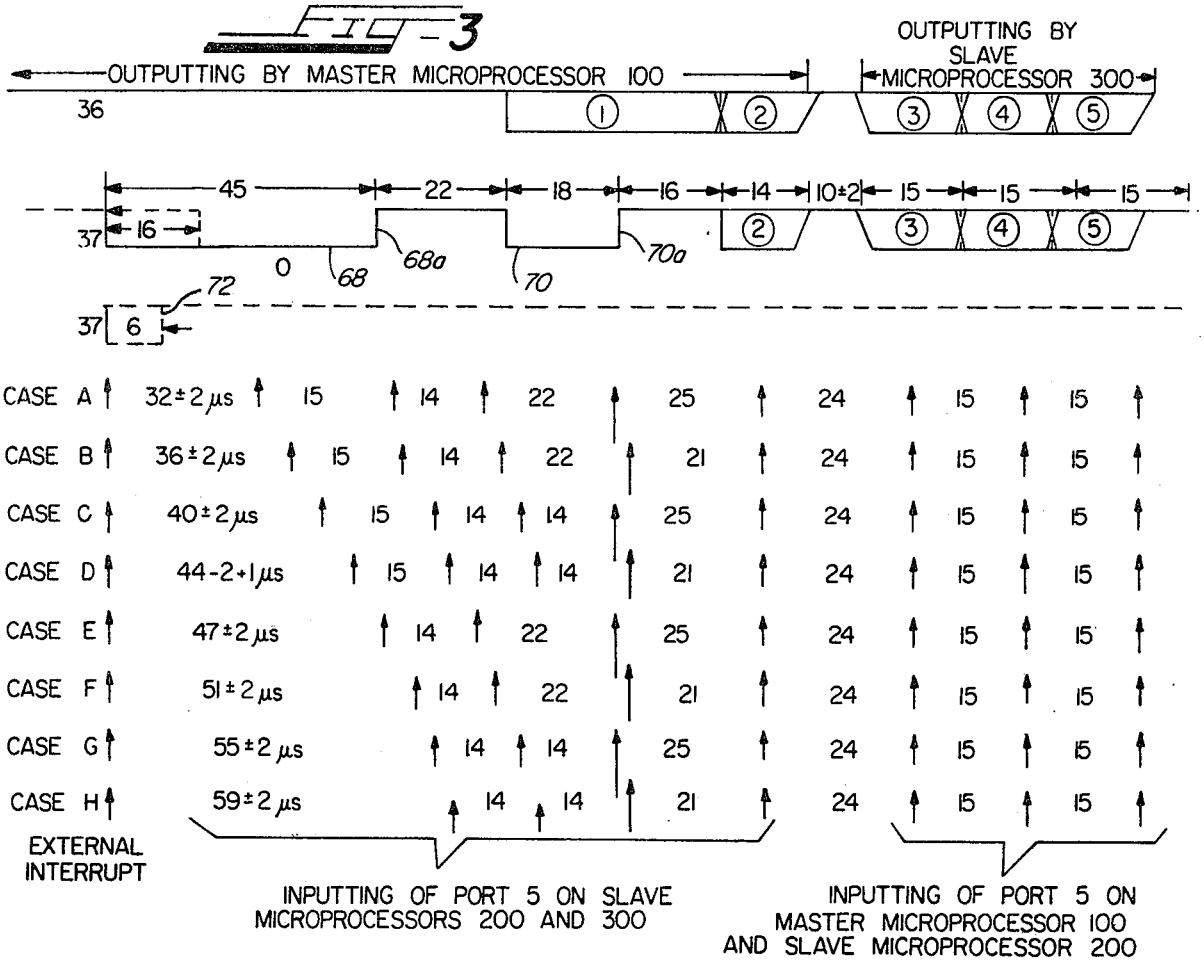
FIG. 3 is a diagram illustrating a synchronizing signal of the type utilized in the present invention.

The synchronizing signal for synchronizing the communication of data between microprocessors is supplied by the master microprocessor 100 on line 12*h* as illustrated in FIG. 3. Data being communicated corresponding to bits B6 and B7 also is illustrated in FIG. 3. The example illustrated in FIG. 3 is typical for communication 1, with communications 2, 3, 4, and 5 being hypothetical cases showing master-to-slave, slave-to-master, and slave-to-slave communication. The vertical arrows in FIG. 3 show the times at which the slave microprocessors obtain samples of the waveforms and illustrate the synchronization achieved by the slave microprocessors after commencement of the synchronizing signal. By running all of the microprocessors on the same clock (e.g., 4 MHz), the time intervals (given in microseconds in FIG. 3) can be accurately maintained. Although it is possible to send and receive a communication every 10 microseconds, a more practical rate is every 15 microseconds, which permits the use of a compact set of instructions for outputting a block of information from the scratch pad memory of the microprocessor, as described below. Another compact set of instructions is used for receiving the block of information and putting it into the scratch pad memory.

In one embodiment the size of the block of data transmitted depends upon the initial value of a scratch pad memory pointer. Thus, for example, a scratch pad pointer (i.e., an address of the location in a scratch pad memory containing the data which is to be transmitted) can be incremented during each pass through a program loop with data from the scratch pad pointer location being outputted during each pass through the loop. For example, when using the commercially available type 3870 microprocessor for this purpose, the following standard instructions can be used to create this loop:

| | |
|---|---|
| LR | A, I |
| OUTS | 5 |
| BR7 | *−2 |

After the scratch pad pointer has been incremented to seven, the branch instruction no longer loops back, and the program continues. Therefore, in this example, if the scratch pad memory pointer is zero initially, seven bytes of data are transmitted.

A synchronizing signal can be outputted by the master microprocessor approximately every 5.2 milliseconds to cause the slave microprocessors to interrupt the execution of their main programs for data communication to take place. By communicating at these intervals, if, for example, the rhythm voice bits are obtained and timed in microprocessor 100 and then communicated to microprocessor 200 to be outputted, the accuracy of the rhythm beats is approximately plus or minus 2.6 milliseconds, irrespective of the tempo. Thus, at a fast tempo of 300 quarter notes per minute, the sixteenth notes will have spacings of 52 milliseconds alternating with 46.8 milliseconds often enough to average 50 milliseconds. This provides 1200 sixteenth notes (and 300 quarter notes) per minute. Data can be transmitted between a particular pair of microprocessors during every communication, during alternate communications, or as often as necessary. For example, rhythm voice bits need to be communicated only when there are sixteenth or twelfth notes to be sounded.

It is desirable to have the arrows which represent the timing of the execution of input instructions in FIG. 3 centered between the transitions of the data waveform due to the output instructions of the transmitting microprocessor. In the synchronizing method of the present invention, synchronization is achieved to within plus or minus two microseconds. In FIG. 3, a hypothetical communication 3 transmitted by microprocessor 300 to microprocessor 200 has a time uncertainty of plus or minus two microseconds. Therefore, microprocessor 200 has an uncertainty of plus or minus four microseconds in receiving the exact center of communication 3. The maximum uncertainties possible determine how long the communications must remain static to assure that any other timing errors that might exist in individual microprocessors do not affect the accuracy of communications.

In order to achieve synchronization among the microprocessors, the master microprocessor 100 sends out a synchronizing signal comprised of two negative pulses, which, for example, can be 45 and 18 microseconds long, respectively, and spaced 22 microseconds apart. In one embodiment this synchronizing signal is outputted as bit B7 on line 12*h* of the communications bus, and received on the external interrupt terminals 34 and 36 of slave microprocessors 200 and 300, respectively, which are connected to line 12*h*. When the leading edge 68*a* of the first negative pulse 68 is received on the external interrupt terminals 34 and 36, an "interrupt" of microprocessors 200 and 300 occurs. Typically, each of the slave microprocessors is performing its "main program" when an interrupt occurs. When an interrupt occurs, the microprocessor interupts execution of its main program and commences execution of an "interrupt program." At the time of the interrupt, the accumulator, status, and memory pointer are saved by the slave microprocessor so that when the interrupt is completed execution of the main program can begin where it left off.

In the preferred embodiment the interrupt does not immediately produce exact synchronization. This delay occurs because, among other things, certain privileged instructions in the main program for each slave microprocessor always are completed before an interrupt sequence is started. As a result of the execution of the privileged instructions, there will be a delay, for example, of 34 to 54 microseconds (see FIG. 3) after the start of the synchronizing signal before the slave microprocessor executes its first input instruction. The input instruction causes the high or low state of the collectors of the transistors associated with bits B0 through B7 to be transferred as one's and zero's to corresponding bits in memory.

Figure 4:
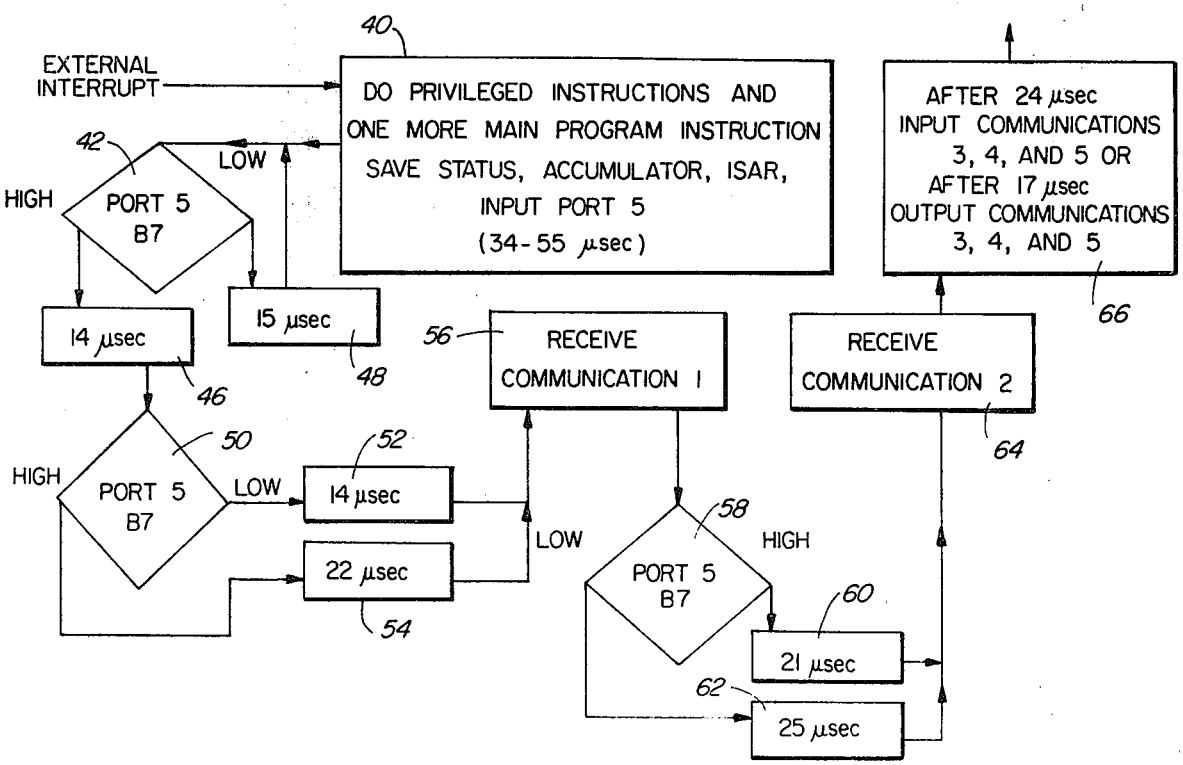
FIG. 4 is a flow diagram illustrating the sequence of instructions executed by a microprocessor in order to receive data being communicated by a connected microprocessor.

Following receipt of the interrupt signal (i.e., the first negative pulse 68), the input instruction is repeated by the interrupt program at regular intervals (e.g., at 15 microsecond intervals) until bit B7 of the communication bus becomes high, which is the case after the end of the 45 microsecond pulse 68 (see FIG. 3). Following each of these input instructions, bit B7 is tested by the slave microprocessors 200 and 300 to determine whether it is in the low or high state. Depending upon whether bit B7 is found to be in the low or high state, a predetermined delay occurs before the subsequent input instruction is executed, as illustrated in FIG. 4 and described hereinafter. If it is found that there is a greater uncertainty in the interrupt delay than 54 microseconds due to execution of privileged instructions, it is merely necessary to lengthen the 45 microsecond pulse in order to achieve synchronization. A disadvantage of lengthening the 45 microsecond pulse is that more time is expended before useful communication can begin.

The synchronizing signal and exemplary communications are illustrated in FIG. 3. Communications 1 through 5 are illustrated for bits B7 and B6 and by the top two lines in FIG. 3. Also illustrated in FIG. 3 is the synchronizing signal which appears on bit B7 (i.e., line 12*h*) and which is comprised of two negative pulses 68 and 70. Cases A through H in FIG. 3 illustrate how synchronization is achieved when the initial delay has one of eight particular values. The numbers between the vertical arrows indicate the delay times which are added to achieve synchronization after each sampling of the synchronizing signal, as described hereinafter.

FIG. 4 is a flow chart of the synchronizing portion of the interrupt program executed by a slave microprocessor when it receives a synchronizing signal on its external interrupt terminal. As indicated by block 40 in FIG. 4, upon receiving a synchronizing signal, the next succeeding privileged main program instructions are executed plus one additional main program instruction before the status, accumulator contents, and memory pointer are stored for use when the interrupt ends and execution of the main program is resumed. Next, the data bits B0 through B7 appearing on lines 12*a–h* are input into the microprocessor and stored in memory. Bit B7 is then tested, as indicated by block 42, to determine whether it is in the high or low state. If it is in the low state, a delay of 15 microseconds occurs, following which the test is repeated. When bit B7 is in the high state an inherent delay of 14 microseconds occurs, which is inherent in the operation of the microprocessor, at which time bit B7 is tested again as illustrated by block 50. By the time the microprocessor has executed instructions corresponding to decision block 50 in FIG. 4, which occurs during the 22-microsecond interval in FIG. 3, synchronization has been achieved to within plus or minus eight microseconds. If the initial tests were repeated more frequently than once every 15 microseconds, greater initial accuracy could be obtained, and the final accuracy (as discussed below) could be better than plus or minus two microseconds. If the sampling indicated by block 50 shows that bit B7 is in the low state another delay of 14 microseconds occurs, as indicated by block 52. If, on the other hand, bit B7 is in the high state (i.e., the 22-microsecond interval has not ended yet, a delay of 22 microseconds occurs as indicated by block 54. After the foregoing delay the slave microprocessor is synchronized to within plus or minus four microseconds as indicated in FIG. 3 by the arrows aligned on either side of the leading edge 70*a* of the 18-microsecond pulse 70. At this time, the first communication can be received, as indicated by block 56. A final sampling of bit B7 of port 5 is conducted, as illustrated by block 58. Remaining timing errors indicated by the arrows in FIG. 3 are eliminated by adding an additional twenty-one or twenty-five microseconds of delay (as indicated by blocks 60 and 62, respectively) if the test indicated by block 58 shows that the 18 microsecond pulse has not yet ended. The delays represented by blocks 46, 48, 52, 54, 60, and 62 in FIG. 4 are provided by the execution of instructions by the microprocessor.

As illustrated by the vertical arrows in FIG. 3, following the additional delay of 21 or 25 microseconds synchronization is achieved to within plus or minus two microseconds depending upon the initial delay. The second communication is received at this time, as indicated by block 64 in FIG. 4, followed by the sending or receiving (depending upon the particular microprocessor 100, 200, or 300) of additional communications as indicated in block 66. If the initial delay is one of the nominal values illustrated as cases A through H in FIG. 3, perfect synchronization is achieved by this final correction. Each of cases A through H has an uncertainity of plus or minus two microseconds, however, and this error is carried through to the final arrow in the middle of communication 2. All inputting and outputting that the slave microprocessor does during the rest of the communication occurs with this error. However, by transmitting each of the data signals for a sufficient length of time, the timing inaccuracies of inputting and outputting do not affect the accuracy of the data communications. If greater synchronization accuracy is desired, additional synchronization pulses can be sent by the microprocessor. For example, a third synchronization pulse could be sent by master microprocessor 100, sampled two more times by slave microprocessors 200 and 300, and delays introduced to improve the final accuracy to plus or minus one-half microsecond.

Figure 1A:
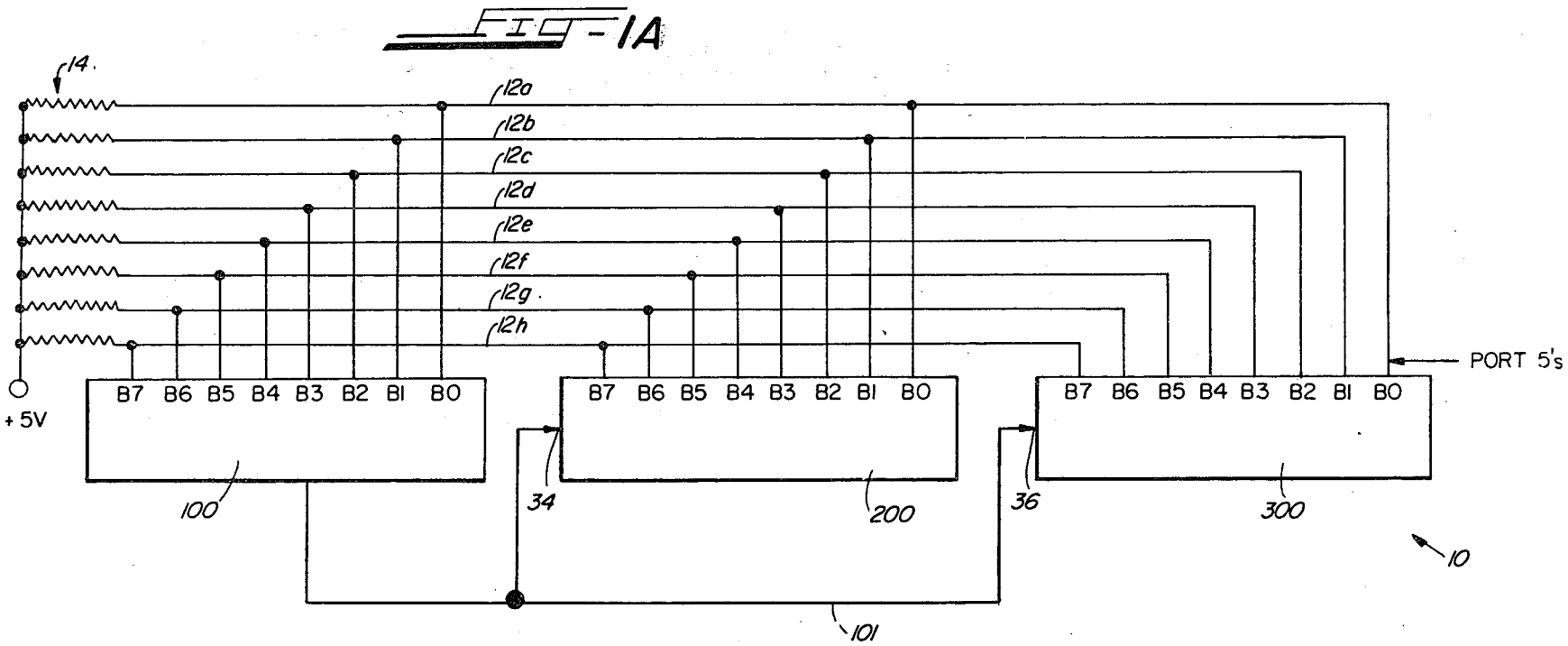

In an alternative embodiment of the present invention illustrated in FIG. 1A, a separate interrupt pulse 72 generated by the master microprocessor 100 is supplied on line 101 to the interrupt terminals 34 and 36 of slave microprocessors 200 and 300. For purposes of illustration, in FIG. 3 interrupt pulse 72 is six microseconds in width. Ten microseconds after interrupt pulse 72, the normal synchronizing signals are provided on line **12*h* of the communication bus, with the exception that the first 16 microseconds of the first negative pulse 68 is missing. Synchronization occurs in exactly the same way as when the interrupt signal is supplied on line 12*h* in the embodiment described above. The advantage of not supplying the interrupt signal on the same line as data (bit B7 on line 12*h*) is that if the interrupt program of a slave microprocessor occasionally lasts longer than the time between synchronizing signals, an interrupt of that slave microprocessor is not enabled by data bit B7 on line 12*h*. If the synchronizing signal is missed and an interrupt enabled by data, correct synchronization would not occur thereby causing data to be received incorrectly. In the alternative embodiment in which the interrupt pulse is provided on line 101**, when the interrupt program occasionally runs beyond the beginning of the next succeeding communication, the next succeeding communication is simply missed. In that case, after execution of the interrupt program is completed the main program is executed by the slave microprocessor, instead of executing the interrupt program again, during the remaining portion of the next 5.2 milliseconds.

Following the periods of synchronizing delay, the first communication is received by means of appropriate input instructions which are executed by the receiving microprocessors. As noted above, execution of the input instruction causes the low or high state of the collector of the transistor for each bit B0 through B7 of the receiving microprocessor to be stored in a corresponding register as a zero or a one. As illustrated in FIG. 3, it should be noted that communication 1 starts during the final stage of synchronization, but that only seven bits can be communicated at that time. During the first communication bit B7 cannot be used for data since communication 1 occurs while line **12*h* is still communicating the synchronizing signal. All other communications among the microprocessors can handle eight bits (i.e., one byte) of data at a time as illustrated in FIGS. 1 and 1A**.

While the preferred embodiment of the invention has been illustrated and described, it is to be understood that the invention is not limited to the precise construction herein disclosed, and the right is reserved to all changes and modifications coming within the scope of the invention as defined in the appended claims.

I claim:

1. In an electronic musical instrument having microprocessors for controlling the sounding of music, apparatus for communicating data among the microprocessors, said apparatus comprising:

synchronizing signal means for generating a synchronizing signal having a pulse of a predetermined width;

a plurality of microprocessors having external interrupt terminals for receiving said synchronizing signal and causing an interrupt of the microprocessors to occur in response to the receipt of a synchronizing signal, said microprocessors also having data communications ports for receiving and transmitting data and for receiving said synchronizing signal;

communications bus means for interconnecting said communication ports of said microprocessors; and sampling means responsive to the receipt of a synchronizing signal on said external interrupt terminals for sampling the synchronizing signal received on said communication ports via said communication bus means and determining whether said pulse has ended and, depending upon whether said pulse is still occurring when the sampling is made, introducing a predetermined amount of delay so that the inputting of data by said microprocessors occurs synchronously with the transmission of such data by one of said microprocessors.

2. The apparatus as claimed in claim 1 wherein said sampling is repeated until the end of said pulse is detected.

3. The apparatus as claimed in claim 2 wherein the synchronizing signal generated by said synchronizing signal means also has a second pulse of a second predetermined width, the second pulse being spaced from the first pulse by a predetermined time interval, and wherein said sampling means conducts a second sampling to determine whether said time interval is occurring, and a third sampling to determine whether the second pulse is occurring.

4. The apparatus as claimed in claim 3 wherein said sampling means determines whether the first or the second pulse of the time interval is occurring by sampling at predetermined time intervals after receipt of the first pulse to determine whether said synchronizing signal is in a low or high state, and introducing a compensating time delay following each sampling to achieve synchronization.

5. The apparatus as claimed in claim 1 wherein said communication bus means includes a plurality of communication lines, each of said communication lines corresponding to one bit of data and interconnecting the corresponding bit position of said communication ports of said microprocessors.

6. The apparatus as claimed in claim 5 wherein each of said communication ports comprises an open collector type of port.

7. The apparatus as claimed in claim 5 wherein each communication line of said communication bus means is connected to a voltage source, and wherein each of said communication ports further comprises switching means connected between each bit position of said communication port and ground, wherein when said switching means is in a first state the corresponding bit position of said communication port is connected to ground, and wherein when said switching means is in a second state the corresponding bit position of said communication port is not connected to ground.

8. In an electronic musical instrument having microprocessors for controlling the sounding of music, apparatus for communicating data between microprocessors, said apparatus comprising:

master microprocessor means for generating a synchronizing signal, for generating an interrupt pulse, and for transmitting and receiving data, said synchronizing signal including a first timing pulse of a first predetermined duration and a second timing pulse of a second predetermined duration;

slave microprocessor means having data communication ports for receiving said synchronizing signal and for transmitting and receiving data, said slave microprocessor means also having external interrupt terminal means for receiving said interrupt pulse and interrupting the operations of said slave microprocessor means, said slave microprocessor means sampling said synchronizing signal after receiving said interrupt pulse and adding at least one predetermined delay interval before inputting or outputting data depending upon the results of the sampling, whereby data is transmitted and received synchronously between microprocessors.

9. The apparatus as claimed in claim 8 wherein the first timing pulse of said synchronizing signal also comprises said interrupt pulse.

10. In an electronic musical instrument having microprocessors for controlling the sounding of music, a method of communicating data between microprocessors, which comprises:

providing an interrupt signal to interrupt the operations of the microprocessors;

providing a first timing pulse;

conducting a first sampling to determine whether said first timing pulse is occurring and adding a first predetermined delay if said first timing pulse is still occurring;

providing a second timing pulse;

conducting a second sampling to determine whether said second timing pulse is occurring and adding a second predetermined delay if said second timing pulse is still occurring; and communicating data between microprocessors after delaying for a period of time, the length of which is determined by the results of said first and second samplings.

11. In an electronic musical instrument having microprocessors for controlling the sounding of music, a method of communicating data between microprocessors, which comprises:

providing an interrupt signal to interrupt the operations of the microprocessors;

providing a first timing pulse;

conducting a first sampling to determine whether said first timing pulse is occurring and adding a first predetermined delay if said first timing pulse is still occurring;

providing a second timing pulse;

conducting a second sampling to determine whether said second timing pulse is occurring and adding a second predetermined delay if said second timing pulse is not yet occurring; and communicating data between microprocessors after delaying for a period of time, the length of which is determined by the results of said first and second samplings.

12. The method as claimed in claim 11 wherein the first sampling is repeated if said first timing pulse is still occurring, adding said first predetermined delay each time it is repeated to produce a coarse synchronization, and wherein the accuracy of synchronization is further improved by conducting the second sampling.

13. The method as claimed in claim 12 wherein another sampling is conducted and, if the end of said second timing pulse is not yet detected, adding a third predetermined delay to further improve the accuracy of the synchronization between microprocessors.

14. In an electronic musical instrument having microprocessors for controlling the sounding of music, apparatus for communicating data among a plurality of microprocessors, each of the microprocessors having a communications port, said apparatus comprising:

communication bus means for interconnecting the communication ports of each of the plurality of microprocessors;

synchronizing signal means connected to said communication bus means for generating a synchronizing signal having at least two pulses of predetermined width and spacing;

sampling means for sampling the synchronizing signal at predetermined time intervals and for detecting whether a pulse or a space between pulses is occurring; and delay means responsive to whether a pulse or a space between pulses is detected by said sampling means for providing a predetermined delay to said sampling means whereby synchronization more accurate than the initial time intervals is achieved; and communicating means responsive to said sampling means for communicating data among the communications ports of the microprocessors, wherein said communicating means commences communicating data after the end of said second pulse has been detected by said sampling means.

* * * * *